United States Patent [19]

Krupp

[11] 4,135,146

[45] Jan. 16, 1979

[54] PORTABLE HANDCLAP GENERATOR

[75] Inventor: Gerald L. Krupp, El Paso, Tex.

[73] Assignee: Flora Blameuser, Skokie, Ill.

[21] Appl. No.: 825,654

[22] Filed: Aug. 18, 1977

[51] Int. Cl.[2] ..... G08B 3/00

[52] U.S. Cl. ..... 340/384 E; 340/384 R

[58] Field of Search ..... 340/384 E, 384 R; 84/1.01

[56] References Cited

U.S. PATENT DOCUMENTS 3,868,684 2/1975 Nunn ..... 340/384 E

*Primary Examiner*—Harold I. Pitts

*Attorney, Agent, or Firm*—Rummler & Snow

[57] ABSTRACT

An portable electronic device that generates sound of handclapping. A small, easily-carried and easily-used device that eliminates fatigue from physical clapping and makes the user appear more sophisticated.

9 Claims, 2 Drawing Figures

PORTABLE HANDCLAP GENERATOR

BACKGROUND OF THE INVENTION

Persons with arthritic hands or injured hands, when attending a concert or the like, would like to clap their hands together to show their appreciation for the performance but cannot because of this infirmity.

There are no known previous concepts or designs to specifically replace the use of human hands for clapping in live audiences.

SUMMARY OF THE INVENTION

The gist of this invention including components comprises a timer circuit which is used to determine a useful interval between authentic clapping sounds. This interval may be a fraction of a second or more, typically one-half to one-third of a second. An overdamped oscillator having a normal frequency output of from 1,000 to 2,000 Hertz is repetitively blocked by the timer circuit to stay on only long enough to simulate an authentic sounding clap, typically for about 10 to 20 cycles of the oscillator for each clap sound. A typical amplifier operationally connects to the pulsed output of the blocked oscillator for intermittently driving a conventional diaphragm-type loudspeaker. A battery supplies electrical power to the system components through a common coupling means. The device is small and readily portable.

THE PREFERRED EMBODIMENT

Figure 2:
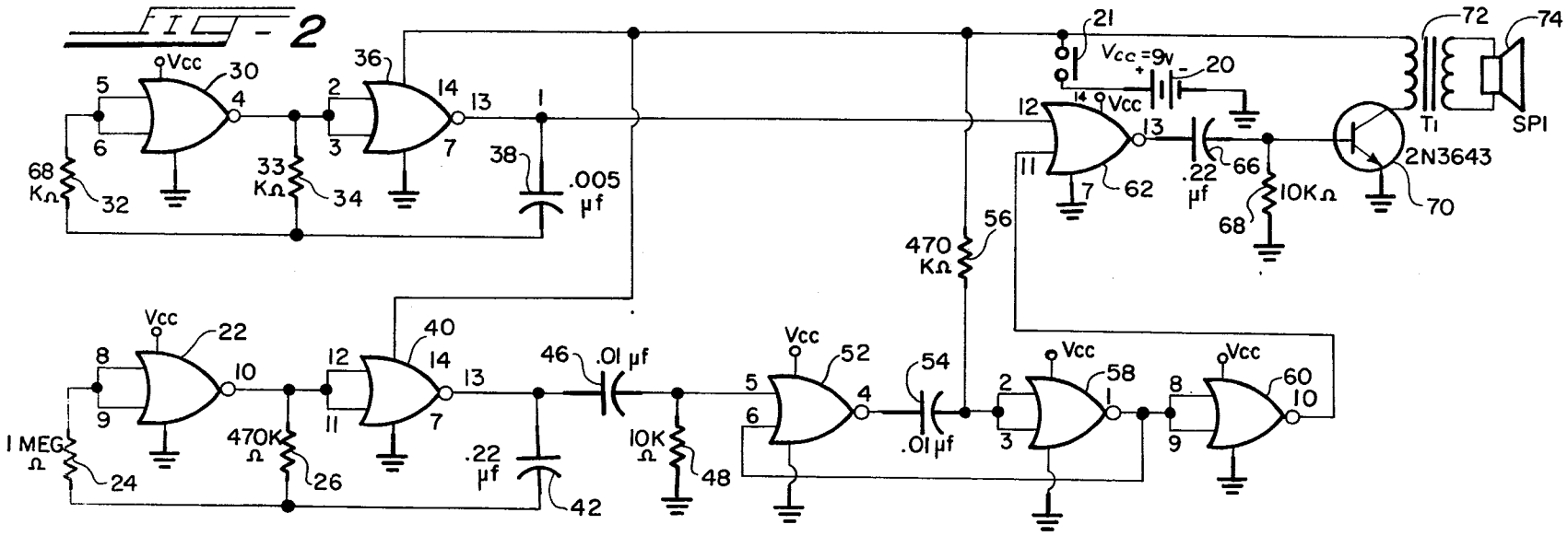
FIG. 2 shows the circuit diagram of the same.
Figure 1:
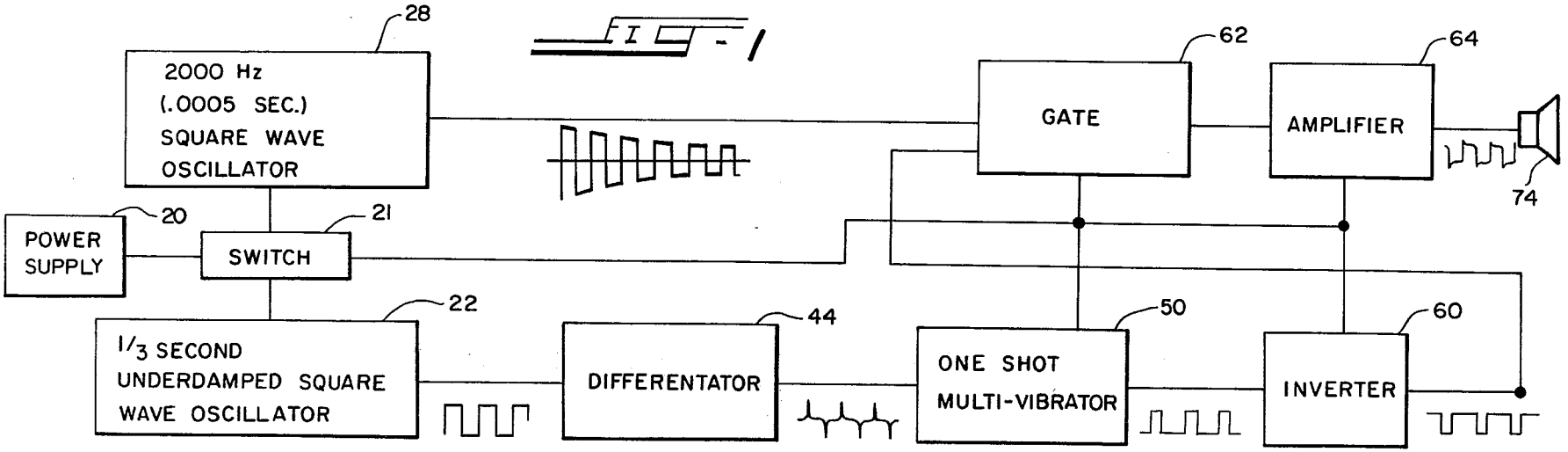
FIG. 1 shows a logic diagram comprising the essential components of the portable handclap generator shown as blocks wherein the relationship between components is indicated by appropriately connected lines with the corresponding signal waveform in each line shown to one side.

Reference to FIG. 1 shows a power supply 20, an underdamped square wave oscillator 22 having a period of one-third second and comprising a first, positive, complementary metal oxide silicon (CMOS) NOR gate or inverting logic element such as a NAND gate, an inverting buffer, an inverter, a Schmitt trigger, Schmitt NAND gate or low-power Schottkey device 22 operationally connecting in conventional manner to the hot terminal of a 9-volt transistor battery power supply 20 through pushbutton switch 21 and to ground, and having its No. 8 and No. 9 insulated gate field effect transistor gate input terminals connected in common, as shown in FIG. 2. A 1.0 megaohm resistor 24 connects to the commonly-connected No. 8 and No. 9 input terminals of NOR gate 22. A 470K ohm resistor 26 connects to the output terminal No. 10 from said first NOR gate 22 in feedback relation through the 1.0 megaohm resistor 24 to the commonly-connected No. 8 and No. 9 input terminals thereof.

A 2,000 Hertz (0.0005 sec.) ordinary square wave oscillator 28 in which the gain is very high and the output wave clipped and square comprising a second, positive CMOS NOR gate or inverting logic element 30 operationally connects in the conventional manner to the hot terminal of the power supply 20 through pushbutton switch 21 and to ground, and has its No. 5 and No. 6 diode input terminals commonly connected, as shown in FIG. 2. A 68K ohm resistor 32 connects to the commonly-connected No. 5 and No. 6 input terminals of NOR gate 30. A 33K ohm resistor 34 connects to the output terminal No. 4 from second NOR gate 30 in feedback relation through the 68K ohm resistor 32 to the commonly-connected No. 5 and No. 6 input terminals of NOR gate 30.

A third, positive CMOS NOR gate or inverting logic element 36 likewise operationally connects its No. 14 supply voltage terminal in a conventional manner through pushbutton switch 21 and to ground, and to the hot terminal of power supply 20 and has its No. 2 and No. 3 diode input terminals commonly connected, as shown in FIG. 2. A first 0.005 microfarad capacitance 38 connects the output terminal No. 1 from third NOR gate 36 in feedback relation through the 33K ohm resistor 34 to the commonly-connected No. 2 and No. 3 input terminals to NOR gate 36. No. 7 terminal thereof connects to ground.

A fourth, positive CMOS NOR gate or inverting logic element 40 operationally connects its No. 14 supply voltage terminal to the output terminal No. 1 of NOR gate 36. A second 0.22 microfarad capacitance 42 connects the output terminal No. 13 from fourth NOR gate 40 in feedback relation through the 470K ohm resistor 26 to the commonly-connected No. 11 and No. 12 input terminals to NOR gate 40. No. 7 terminal thereof likewise connects to ground.

A differentiator 44 operationally connects to the output terminal No. 13 from NOR gate 40 and comprises a third 0.01 microfarad condenser 46 connecting the terminal of one plate to said output terminal No. 13 thereof and the terminal of its other plate through a 10K ohm resistor 48 to ground. A one-shot multivibrator 50 comprising a fifth, positive CMOS NOR gate connects its No. 5 diode input terminal to the terminal of the other plate of said third condenser 46. A fourth 0.01 microfarad condenser 54 connects the terminal of one plate to the output terminal of said NOR gate 52 and the terminal of its other plate through a 470K ohm resistor 56 to the power supply 20 through the pushbutton switch 21. A sixth, positive CMOS NOR gate or inverting logic element 58 operationally connects in the conventional manner to the hot terminal of power supply 20 through pushbutton switch 21 and to ground having its No. 2 and No. 3 diode input terminals commonly connected, as shown in FIG. 2, to the terminal of the other plate of said fourth condenser 54. The output terminal of NOR gate 58 connects in feedback relation to the other No. 6 diode input terminal of said NOR gate 52.

A seventh inverter or inverting logic element 60 operationally connects in a conventional manner to the hot terminal of power supply 20 through pushbutton switch 21 and to ground, and has its No. 8 and No. 9 diode input terminals commonly connected to the output terminal No. 1 of the NOR gate 58. An eighth, positive CMOS NOR gate 62 operationally connects in the conventional manner to the hot terminal of the power supply 20 through pushbutton switch 21 and to ground, and has its input diode terminal No. 11 operationally connected to the output terminal No. 10 of inverter 60, and its input diode terminal No. 12 operationally connected to the output terminal No. 1 of NOR gate 36 of oscillator 28. An isolation stage amplifier 64 operationally connects its input terminal to the output terminal No. 13 of the NOR gate 62 and comprises a fifth capacitor 66 which operationally connects the terminal of one plate thereof to said output terminal No. 13 of said NOR gate 62 and the terminal of the other plate thereof through a 10K ohm resistor 68 to ground. A 2N3643 NPN transistor 70 has its base terminal connected to the terminal of the other plate of said capacitor 66 and the terminal of its emitter connected to ground. A transformer 72 having an input primary of 125 ohm impedance operationally connects one terminal thereof to the collector terminal of said NPN transistor 70 whereas the other terminal thereof connects to the hot terminal of said power supply 20 through said pushbutton switch 21. The secondary output of said transformer 72 having a step-down transformation ratio of 15.6:1 magnetically couples to said primary thereof and electrically connects at one terminal to one input terminal of a 2½ inch diameter diaphragm-type loudspeaker 74 having a matching impedance of 8 ohms to match the secondary output impedance of said transformer 72 and a linear free-air response from 500–5000 Hertz of 92 dB sensitivity throughout.

Although but one specific embodiment of this invention is herein shown and described, it will be understood that details of the construction shown may be altered or omitted without departing from the spirit of the invention as defined by the following claims.

I claim:

1. A portable handclap generator comprising:

(a) a source of electrical power operationally connected to the power input terminal of an on-off switching means;

(b) a first oscillator means providing a handclap frequency output signal having its power input terminal operationally connected to the output terminal from the on-off switching means;

(c) a second oscillator means providing an audio frequency output signal having its power input terminal operationally connected to the output terminal from the on-off switching means;

(d) a differentiating circuit means having its signal input terminal operationally connected to the output terminal from the second oscillator means providing a pulsed output signal substantially in proportion to the rate of change of signal from the output terminal of said oscillator means;

(e) a monostable circuit means having its power input terminal operationally connected to the output terminal of said on-off switching means and its signal input operationally connected to the output terminal of said differentiating circuit means having a stable state and providing for triggering by said pulsed output signal from the differentiating circuit means to change that state to a quasi-stable state for a predetermined interval before returning to the original state;

(f) an inverting logic circuit means having its power input terminal operationally connected to the output terminal of said on-off switching means and its signal input operationally connected to the output terminal of said monostable circuit means for providing inversion of the input signal from the output terminal of said monostable circuit means;

(g) a gate logic circuit means having its power input terminal operationally connected to the output terminal of said on-off switching means having a first signal input terminal operationally connected to the signal output terminal from said first oscillator means and a second signal input terminal operationally connected to the signal output terminal from said second oscillator means;

(h) an isolation amplifier means having its power input terminal operationally connected to the output terminal of said on-off switching means and its signal input operationally connected to the output terminal of said logic gate means; and (i) loudspeaker means having signal input terminals operationally connected to signal output terminals of the amplifier means.

2. A portable handclap generator as set forth in claim 1 wherein the first oscillator means comprises:

(a) a first inverting logic element having its power supply terminal connected through the pushbutton switch to the positive pole of the D.C. power supply and its signal output terminal connected to its input terminal through a feedback loop having first and second resistors connected in series; and (b) a fourth inverting logic element having its power supply terminal connected through the pushbutton switch to the positive pole of the D.C. power supply and its signal output terminal connected to its input terminal through a feedback loop having a first capacitor and said first resistor in series.

3. A portable handclap generator as set forth in claim 1 wherein the second oscillator means comprises:

(a) a second inverting logic element having its power supply terminal connected through the pushbutton switch to the positive pole of the D.C. power supply and its signal output terminal connected to its input terminal through a feedback loop having third and fourth resistors in series; and (b) a third inverting logic element having its power supply terminal connected through the pushbutton switch to the positive pole of the D.C. power supply and its signal output terminal connected to its input terminal through a feedback loop having a second capacitor and said third resistor in series.

4. A portable handclap generator as set forth in claim 1 wherein the differentiating circuit means comprises:

(a) a third capacitor having its input plate terminal connected to the output terminal from the fourth inverting logic element; and (b) a fifth resistor having one terminal connected to the output plate terminal of the third capacitor and its other plate terminal connected to ground.

5. A portable handclap generator as set forth in claim 1 wherein the monostable circuit means comprises:

(a) a fifth inverting gate logic element having its power supply terminal connected through the pushbutton switch to the positive pole of the D.C. power supply and one input signal terminal connected to the output plate terminal of the differentiating circuit means;

(b) a fourth capacitor having its input signal plate terminal connected to the signal output terminal of the fifth inverting gate logic element and its output signal plate terminal connected through a sixth resistor to the positive pole of the D.C. power supply; and (c) a sixth inverting logic element having its power supply terminal connected through the pushbutton switch to the positive pole of the D.C. power supply, its input terminal connected to the output plate terminal of the fourth capacitor and its signal output terminal connected to the other input signal terminal of the fifth inverting gate logic element through a feedback loop.

6. A portable handclap generator as set forth in claim 1 wherein the inverting logic circuit means comprises a seventh inverting logic element having its power supply terminal connected through the pushbutton switch to the positive pole of the D.C. power supply and its input signal terminal connected to the output signal terminal from the sixth inverting logic element of said monostable circuit means.

7. A portable handclap generator as set forth in claim 1 wherein the gate logic circuit means comprises an eighth inverting gate logic element having its power supply terminal connected through the pushbutton switch to the positive pole of the D.C. power supply, one input signal terminal connected to the output signal terminal of the seventh inverting logic element and the other signal input terminal connected to the output signal terminal of the third inverting logic element of the second oscillator means.

8. A portable handclap generator as set forth in claim 1 wherein the isolation amplifier means comprises a fifth capacitor having its input plate terminal connected to the output signal terminal of the eighth inverting gate logic element, a seventh resistor having one end connected to the output plate terminal of said fifth capacitor and its other end to ground; a transistor having its base terminal connected to the output plate terminal of said capacitor; a step-down transformer having one of its primary terminals connected to one of the other terminals of said transistor and the other of said terminals of said transistor connected to ground, said other primary terminal of said transformer connected to the power supply terminal through the pushbutton switch to the positive pole of the D.C. power supply.

9. A portable handclap generator comprising a first NOR gate having its power supply terminal connected through the pushbutton switch to the positive pole of a 9 volt D.C. power supply, its No. 8 and No. 9 signal input terminals connected in common and its signal output terminal connected to its input terminal through a feedback loop having 470K ohm and 1 MEG ohm resistors connected in series; a fourth NOR gate having its power supply terminal connected through the pushbutton switch to the positive pole of the D.C. power supply, its No. 11 and No. 12 signal input terminals connected in common and its signal output terminal connected to its input terminal through a feedback loop having a 0.22 microfarad capacitor and said 470K ohm resistor in series; a second NOR gate having its power supply terminal connected through the pushbutton switch to the positive pole of the D.C. power supply, its No. 5 and No. 6 signal input terminals connected in common and its signal output terminal connected to its input terminal through a feedback loop having 33K ohm and 60K ohm resistors in series; a third NOR gate having its power supply terminal connected through the pushbutton switch to the positive pole of the D.C. power supply, its No. 2 and No. 3 signal input terminals connected in common and its signal output terminal connected to its input terminal through a feedback loop having a 0.005 microfarad capacitor and said 33K ohm resistor in series; a 0.01 microfarad capacitor having its input plate terminal connected to the output terminal from the fourth NOR gate, a 10K ohm resistor having one terminal connected to the output plate terminal of the 0.01 microfarad capacitor and its other terminal connected to ground; a fifth NOR gate having its power supply terminal connected through the pushbutton switch to the positive pole of the D.C. power supply, and its No. 5 input signal terminal connected to the output plate terminal of the differentiating circuit means; a 0.01 microfarad capacitor having its input signal plate terminal connected to the output signal terminal of the fifth NOR gate and its output signal plate terminal connected through a 470K ohm resistor to the positive pole of the D.C. power supply; a sixth NOR gate having its power supply terminal connected through the pushbutton switch to the positive pole of the D.C. power supply, its No. 2 and No. 3 input signal terminals connected in common to the output plate terminal of the 0.01 microfarad capacitor, and its signal output terminal connected to the No. 6 input signal terminal of the fifth NOR gate through a feedback loop; a seventh NOR gate having its power supply terminal connected through the pushbutton switch to the positive pole of the D.C. power supply and its No. 8 and No. 9 input signal terminals connected in common to the output signal terminal from the sixth NOR gate; an eighth NOR gate having its power supply terminal connected through the pushbutton switch to the positive pole of the D.C. power supply, its No. 11 input signal terminal connected to the output signal terminal of the seventh NOR gate and its No. 12 signal input terminal connected to the output signal terminal of the third NOR gate; a 0.22 microfarad capacitor having its input plate terminal connected to the output signal terminal of the eighth NOR gate, a 10K ohm resistor having one end connected to the output plate terminal of said 0.22 microfarad capacitor and its other end to ground; an NPN transistor having its base terminal connected to the output plate terminal of said 0.22 microfarad capacitor; a transformer having a step-down ratio of 15.6 to 1.0 and one of its primary terminals connected to the collector terminal of said transistor and the other of said primary terminals connected through the pushbutton switch to the positive pole of the D.C. power supply; the emitter terminal of said transistor connected to ground; a diaphragm-type speaker having one input signal terminal connected to one output terminal of the secondary of said transformer and its other input signal terminal connected to the other output terminal of said secondary.

* * * * *